US006193315B1

(12) United States Patent
Hoshino

(10) Patent No.: US 6,193,315 B1
(45) Date of Patent: Feb. 27, 2001

(54) BACKREST STRUCTURE OF A CHAIR, PARTICULARLY A DRUM CHAIR

(75) Inventor: Yoshihiro Hoshino, Nagoya (JP)

(73) Assignee: Hoshino Gakki Kabushiki Kaisha (JP)

( * ) Notice: Subject to any disclaimer, the term of this patent is extended or adjusted under 35 U.S.C. 154(b) by 0 days.

(21) Appl. No.: 09/492,896

(22) Filed: Jan. 27, 2000

(30) Foreign Application Priority Data

Feb. 26, 1999 (JP) ..... 11-050937

(51) Int. Cl.[7] ..... A47C 1/024
(52) U.S. Cl. ..... 297/353; 297/354.1
(58) Field of Search ..... 297/353, 354.1, 297/354.11, 354.12

(56) References Cited

U.S. PATENT DOCUMENTS 1,000,814 * 8/1911 Johnson ..... 297/353
2,988,398 * 6/1961 Hamilton ..... 297/353
3,059,971 * 10/1962 Becker ..... 297/353

* cited by examiner

*Primary Examiner*—Anthony D. Barfield
(74) *Attorney, Agent, or Firm*—Ostrolenk, Faber, Gerb & Soffen, LLP

(57) ABSTRACT

A backrest for a chair, particularly a drum performance chair, which backrest can be adjusted both in height and in tilt angle with respect to the seat. The backrest has two upright arms. A base body is fixed to the chair seat. The base body has an upstanding part. A holder is supported on the upstanding part of the base body. The holder includes an arm sliding part which engage the backrest arms. The arm holder is pivotable about an axis. A holding plate is screw tightened selectively for holding the arms of the backrest at the selected height or loosened to permit the arms of the backrest to be changed in height. A front and back adjusting screw extending from the holder has a contact part that engages the base body. The degree of tightening of the adjusting screw with respect to the holder determines the tilt angle of the holder and the backrest.

3 Claims, 9 Drawing Sheets

BACKREST STRUCTURE OF A CHAIR, PARTICULARLY A DRUM CHAIR

BACKGROUND OF THE INVENTION

The present invention relates to the backrest for a chair, and particularly for a drum chair.

A backrest of a drum chair is used by a performer to rest between drum performances or to mitigate the instability of his posture by placing both of his legs on the pedal part simultaneously in connection with the use of a twin-bass or a twin drum pedal.

DESCRIPTION OF A PRIOR ART EMBODIMENT

The backrest of a drum chair is ordinarily a normal backrest used for an office chair or a business chair. The drum chair 90 shown in FIGS. 9 and 10 is comprised of a backrest 91, an L-shaped arm 93 and a seat 97. One end of the L-shaped arm 93 is inserted into a holder 95 on the lower surface of the seat 97, where the L-shaped arm 93 is fixed by a fixing screw F1. The position of the backrest in the back and forth direction with respect to the seat 97 is set by adjusting the depth of insertion of the L-shaped arm 93 into the holder.

At the other end of the L-shaped arm 93, the backrest 91 is fixed by a fixing screw F2 after insertion of the insert plate 92 of the backrest 91 into the insertion hole 93*a*. The height of the backrest 91 is set by adjusting the insertion depth of the insert plate 92. For the chair to be transported, it is dismantled into the backrest 91, the L-shaped arm 93 and the seat 97. For use, these parts are reassembled.

The backrest of a chair used in an office, etc. is ordinarily shaped curved to accommodate the shape of the back of a man, with many being sized to fit the width of a human being. This makes it possible for the performer's back to contact the backrest during a performance. As a result, the chair tends to move and threatens to tumble in the worst case.

In addition, it is desirable to adjust the position of the backrest according to the preference or the body type of the performer. In the conventional chair shown in FIG. 9 or FIG. 10, for example, if the L-shaped arm 93 is lightly inserted into the holder 95, the fixing between the L-shaped arm 93 and the holder 95 tends to loosen when the performer starts resting on the backrest. As a result, the L-shaped arm 93 is almost always deeply inserted.

Moreover, adjustment of the height of the backrest 91 has been limited to the depth of the insertion hole 93*a* of the L-shaped arm 93, and it is not extendable to a full range as desired by the performer.

Moreover, a compact construction is desirable to make it easier to transport the chair. In a conventional chair, dismantling of the fixed screw F1 alone does not make the chair compact enough, and the extra dismantling of the fixed screw F2 is required. This makes it unsatisfactory as the backrest of a drum chair.

SUMMARY OF THE INVENTION

This invention has an object of solving the foregoing problems. It provides a backrest structure for a chair, particularly a drum chair, which does not pose an obstacle to the performer, which can be adjusted at the desire of the performer, and is of a compact construction, making it easier to transport.

The backrest, particularly of a drum chair, of the invention has a structure in which the backrest is freely adjustable in its height and its tilt angle with respect to the seat and it can be detached when necessary. The chair comprises a main base body which is fixed to the seat and which has an upstanding part on the back of the seat, a main backrest body where the backrest part is installed and which comprises two arms at the right and at the left, with a certain distance between them, an arm holder which is comprised of a support which is held freely rotatably in the back and forth direction through an axle at the standing part of the main base body, and arm sliding part which contacts the inner surfaces of the right and left arms. An arm fixing screw is protuberantly provided on the inner side of the said arm sliding part. A screw hole is formed in opposition to the upstanding part of the main base body. An arm holding plate has a through hole into which the arm fixing screw is inserted and that plate has flanges which slidingly contact the outsides of the right and left arms. The height of the arm holding plate is such that it can be accommodated inside the arms at the right and at the left when that plate is rotated 90 degrees, with the said insertion hole at its center. A front and back adjusting screw is screwed into a threaded part of the arm holder and includes a contact part which contacts the upstanding part of the main base body at the tip of that screw. The arm holder is rotatable around its axle upon the movement of the contact part by the screw. An arm fixing nut is screwed from outside of the arm holding plate onto the arm fixing screw of the arm holder for setting the backrest height.

Other objects and features of the present invention are explained below with reference to the attached drawings.

DESCRIPTION OF A PREFERRED EMBODIMENT

Figure 1:
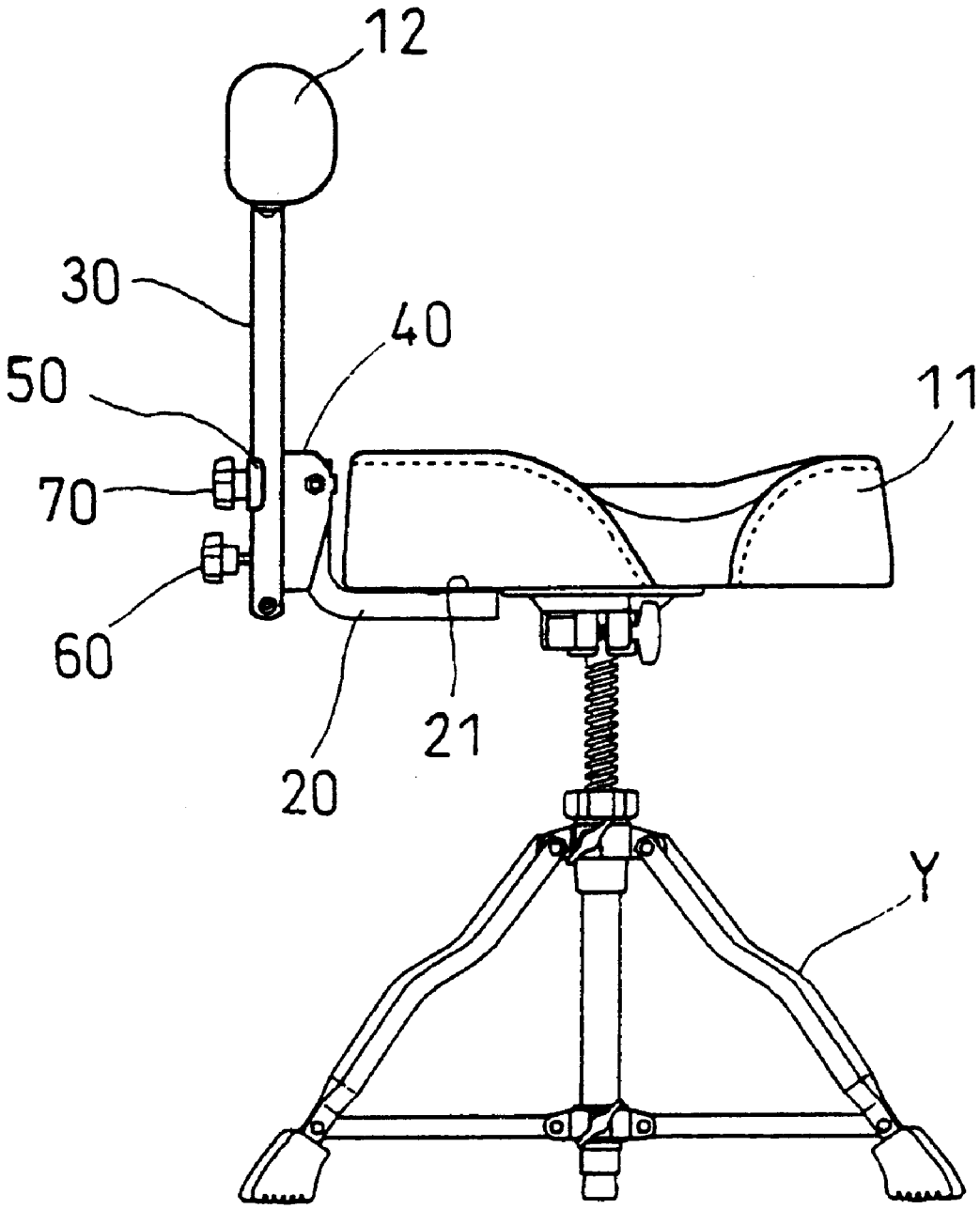
FIG. 1 is a side view of a drum chair having a backrest as an example of the invention.

The backrest of a drum chair according to the invention has a structure enabling the backrest 12 to be freely adjustable in height and tilt angle with respect to the seat 11, and enabling easy dismantling. The backrest comprises a main base body 20, a backrest main body 30, an arm holder 40, an arm holding plate 50, a back and forth adjusting screw member 60 and an arm fixing nut 70.

In FIG. 1, the seat 11 has a concave-convex shape in consideration of user comfort. Legs Y beneath the seat 11 cause the drum chair to be supported at the center of the seat.

Figure 2:
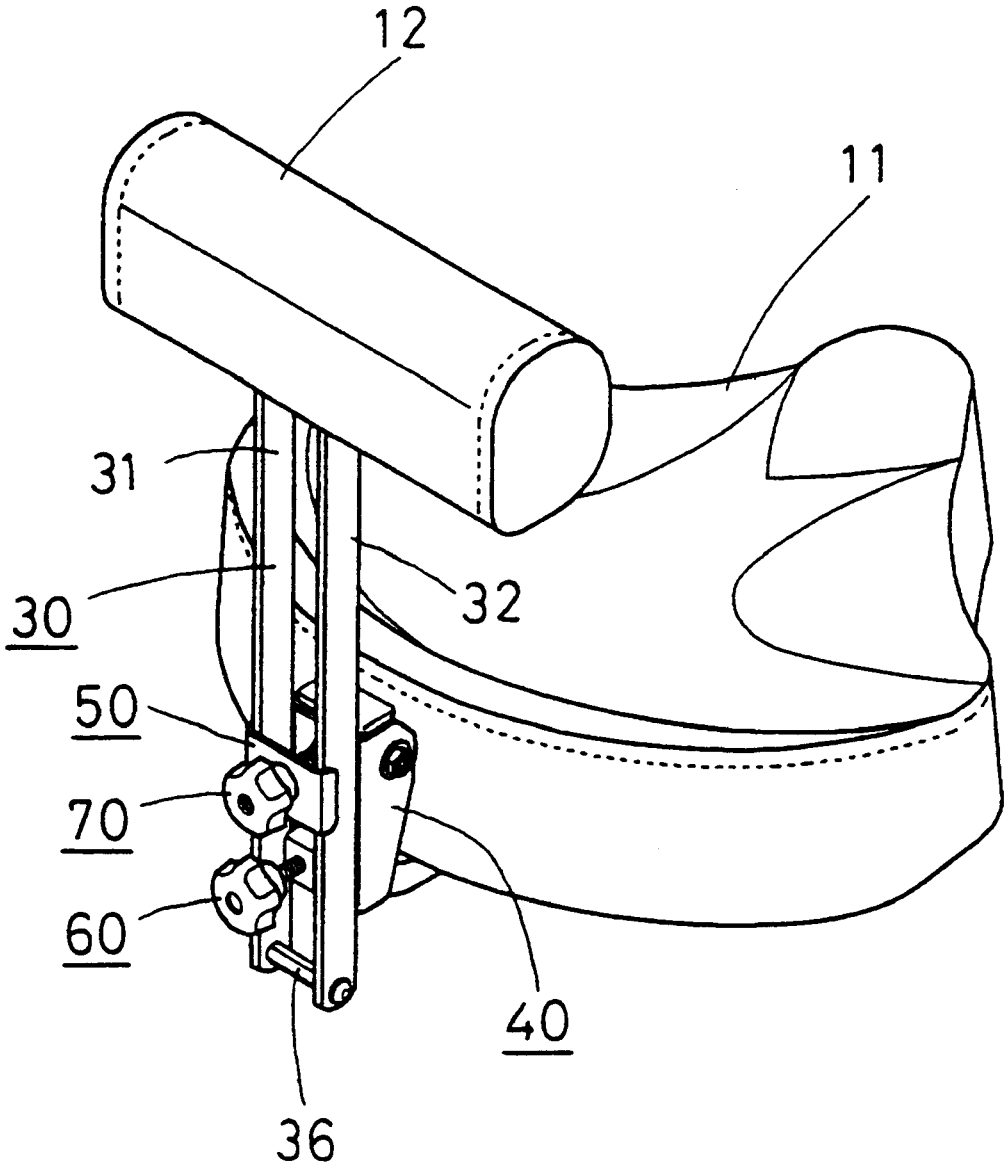
FIG. 2 is an oblique view of the essential parts of the backrest.
Figure 3:
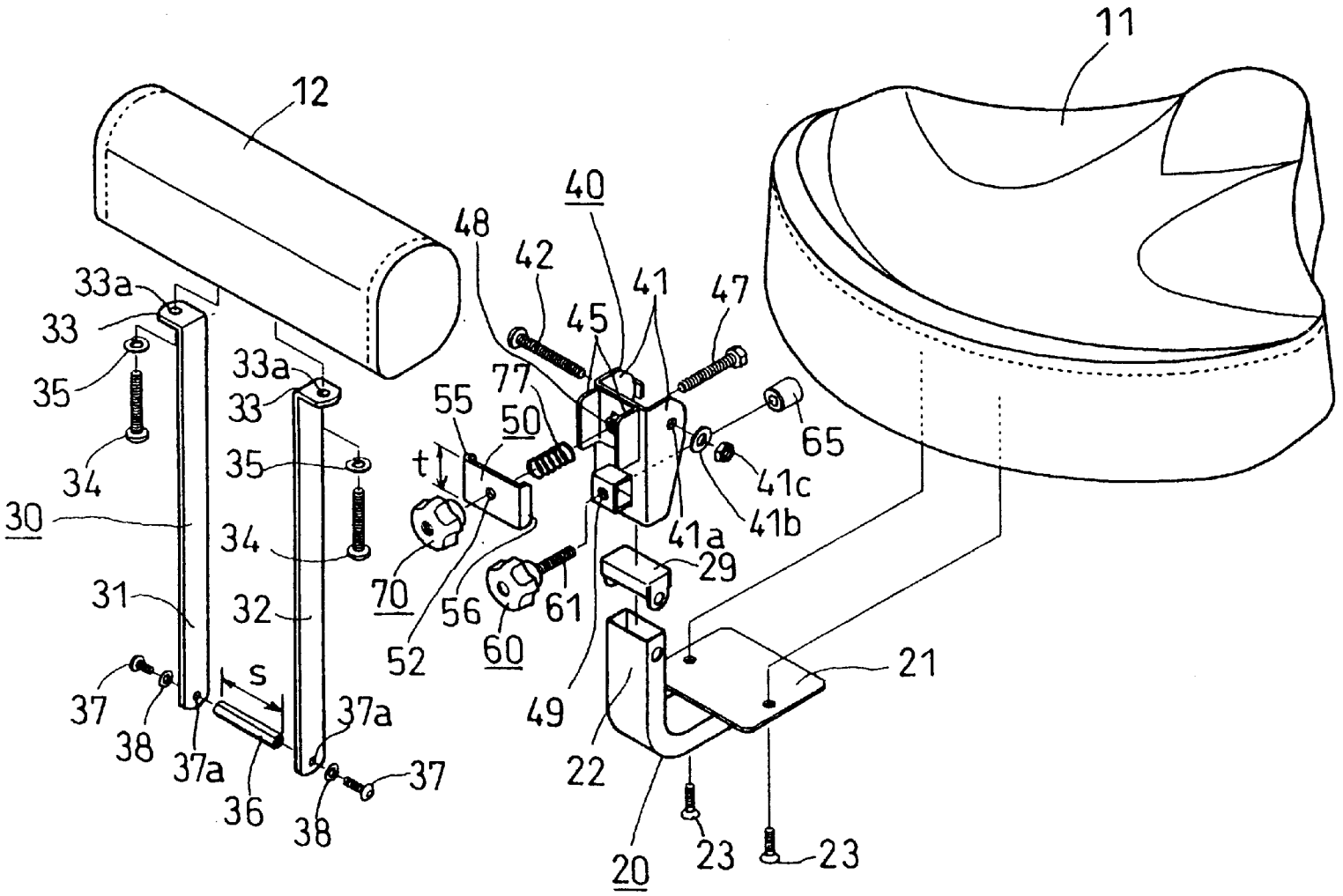
FIG. 3 is an oblique view of the essential part, dismantled.

In FIGS. 1–3, the main base body 20 combines the backrest main body 30, which includes a backrest 12, with the seat 11 to form an integral body. The base body 20 is fixed to the seat 11. The body 20 includes an upstanding part 22 at the rear side of the seat 11. For example, the main base body 20 is L-shape as viewed from the side. It is fixed by installation screws 23 at the lower surface of the seat 11 through an installation plate 21 on one side. A cap 29 covers the top of the main base body 20, which is in the shape of a tube.

The backrest main body 30 supports the backrest 12 so that the back of the performer of the contacts at an upper prescribed position with respect to the seat 11, and the assembly includes the backrest 12 and two arms 31 and 32 to the right and the left below the backrest 12.

The backrest 12 is made of either resin or a fabric, etc. and is formed suitably in the shape of an oval or a cylinder. It can be so small as to contact a part of the back of the performer.

A spacer 36 between the arms 31 and 32 at the lower end of the backrest maintains the arms at a fixed separation. The spacer 36 is fixed to the arms by installation screws 37 through the holes 37*a* in the arms and the spring washers 38.

At the tops of both arms 31 and 32, there are installation parts 33 at the lower surface of the backrest 12. The installation screws 34 pass through the installation holes 33*a* and spring washers 35 and are screwed into the backrest.

The arm holder 40 holds and enables positional adjustment of the backrest main body 30. The holder is comprised of an axial support 41, an arm slider part 45, an arm fixing screw 47 and a screw hole 49.

The axial support 41 holds the arm holder 40 at the upstanding arm 22 of the base body 20 with respect to the back and forth directions through an axle bolt 42. The axle bolt 42 passes through an axle hole 41*a* and is secured by a washer 41*b* and a nut 41*c*.

The two rearwardly projecting arm sliders 45 extend inside the arms 31 and 32 at the right and at the left of the body 30. The slider comprises a groove member with a U-cross section.

An arm fixing screw 47 extends through a fixed screw hole 48 that opens inside of the arm slider 45. The screw 47 passes through the insertion hole 52 of an arm holding plate 50, described below.

A screw hole 49 is in opposition to the upstanding arm 22 of the body 20 and below the fixed screw hole 48. A back and forth adjustment screw 60, described below, is installed in the hole 49.

The arm holding plate 50 holds the two arms 31 and 32 located at the right and at the left of the backrest main body 30 at the prescribed locations of the arm holding member 40. The plate 50 comprises an insertion hole 52 for insertion of the arm fixing screw 47 and flanges 55 and 56 which slidingly contact the outsides of the right and left arms 31 and 32, respectively.

Figure 5:
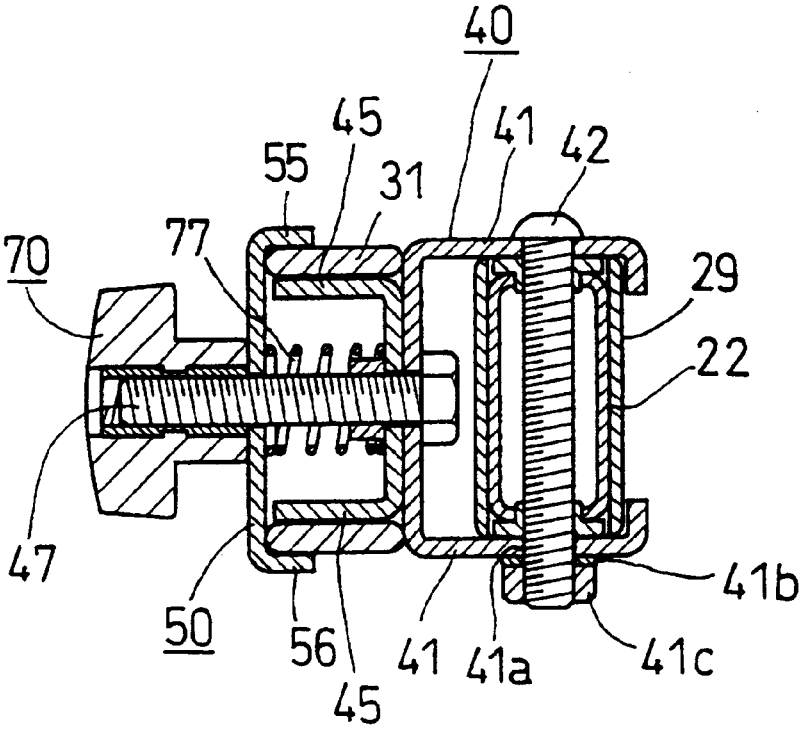
FIG. 5 is a cross section of the essential part of FIG. 4.

FIG. 5 shows that the flanges 55 and 56 of the arm holding plate 50 have inner surfaces in close contact with the outer surfaces of the right and left arms 31 and 32 of the body 30.

Figure 8:
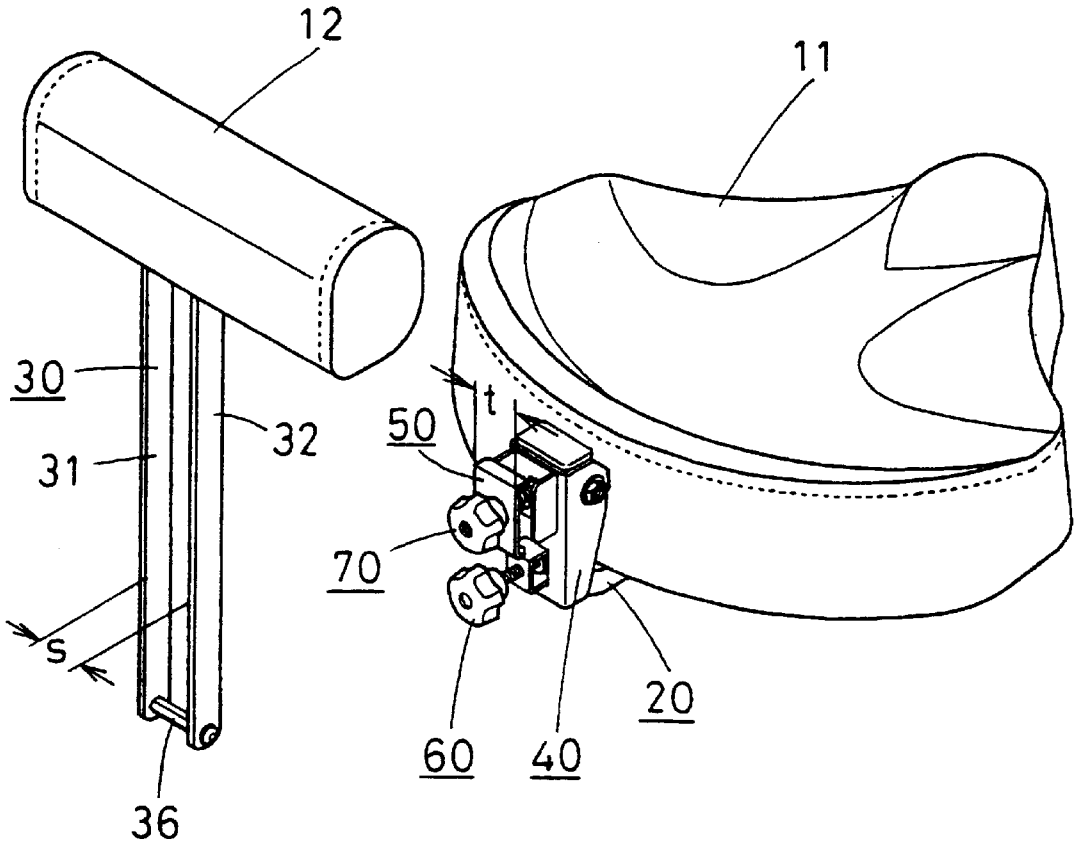
FIG. 8 is an oblique view when the main backrest body has been dismantled from the arm holder.
Figure 9:
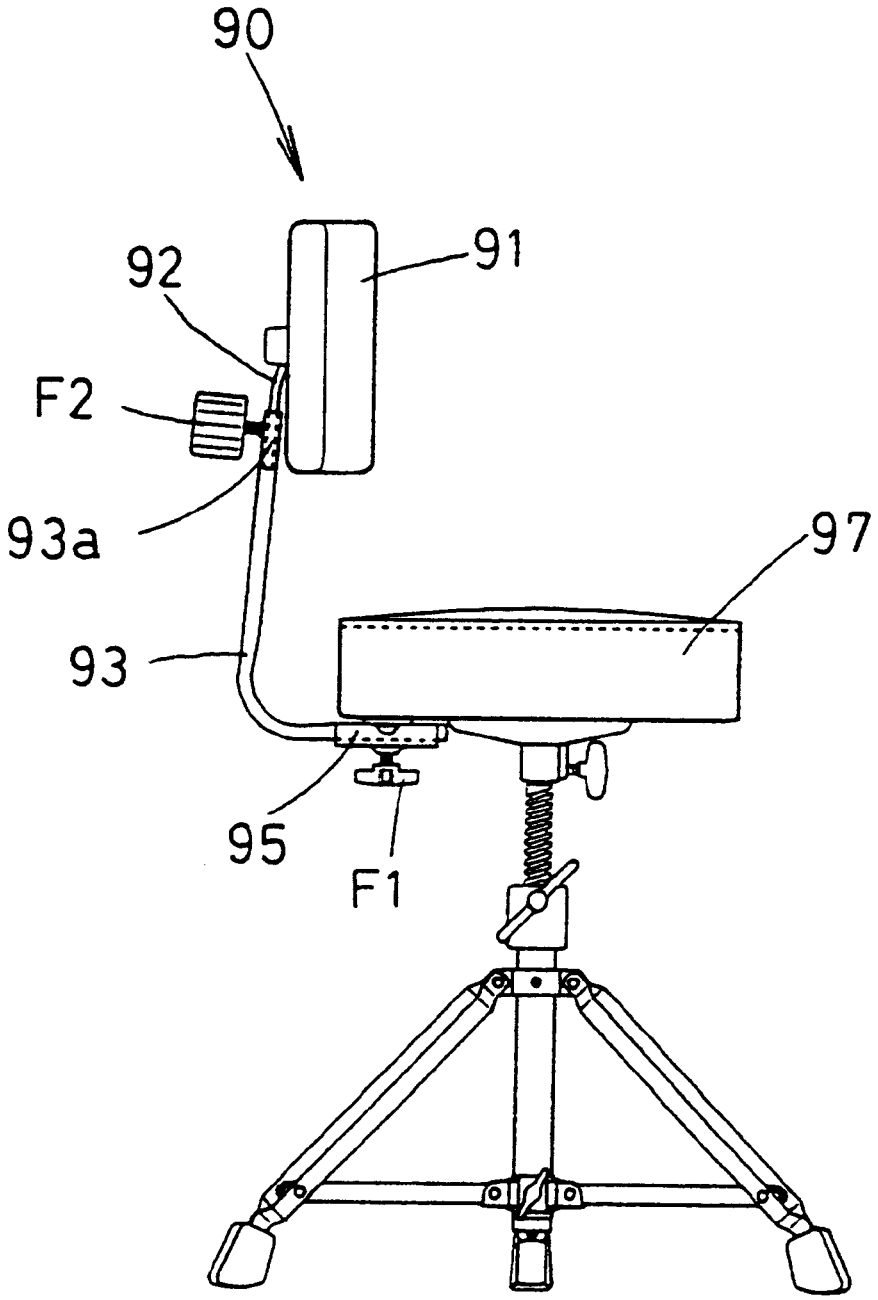
FIG. 9 PRIOR ART
FIG. 9 is a side view showing an example of the drum chair according to prior art.
Figure 10:
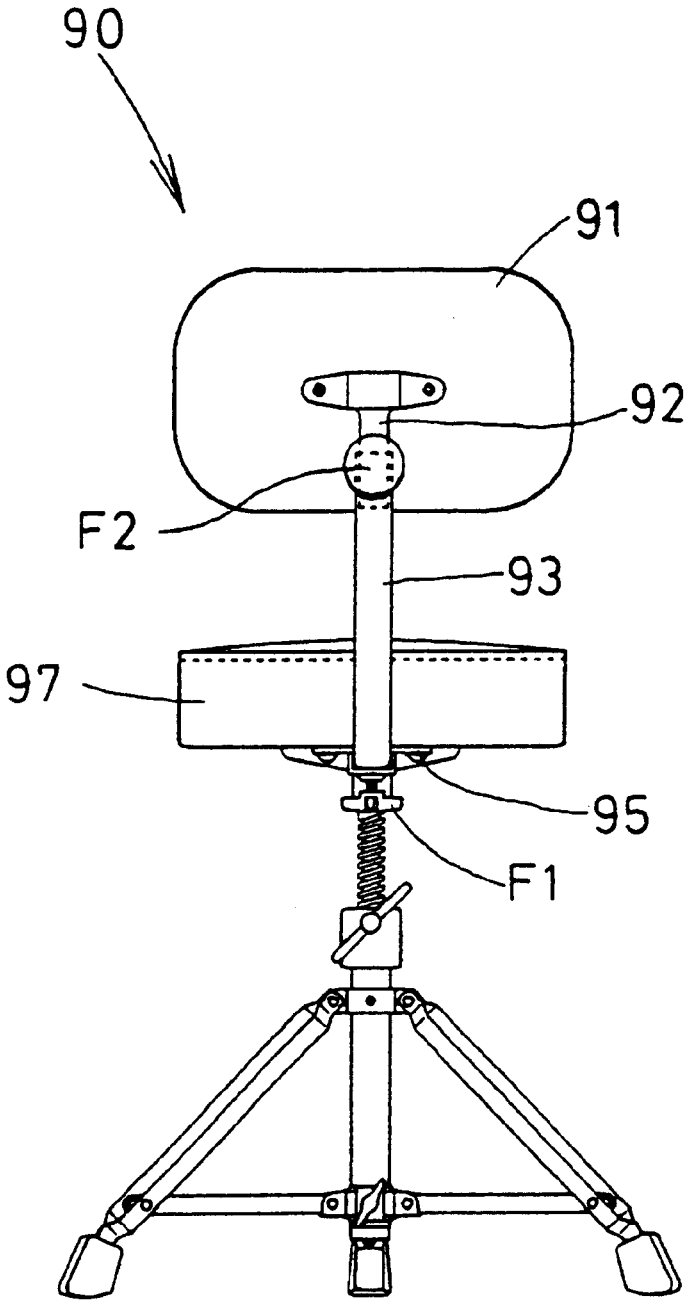
FIG. 10 PRIOR ART
FIG. 10 is a rear view thereof.

In addition, the height of the arm holding plate 50 in its orientation in FIGS. 3 and 5 is such that the plate 50 can be accommodated between the right and left arms 31 and 32 when the plate 50 is rotated 90 degrees with its insertion hole 52 as the center, as shown in FIG. 8. In FIG. 8, the height of the longitudinal side of the arm holding plate 50 is smaller than a fixed distance between the two arms 31 and 32 at the right and at the left.

The back and forth adjustment screw 60 adjusts the angle of the backrest main body 30 which is held on the arm holder 40 by rotating the arm holder 40 around its axial support 41. The screw 60 comprises a screw part 61 which is rotated to a set distance, by being screwed through the screw hole 49 of the arm holder 40. A contact part 65 at the end of the screw part 61 engages the rear facing side of the upstanding arm 22 of the main base body 20.

Figure 4:
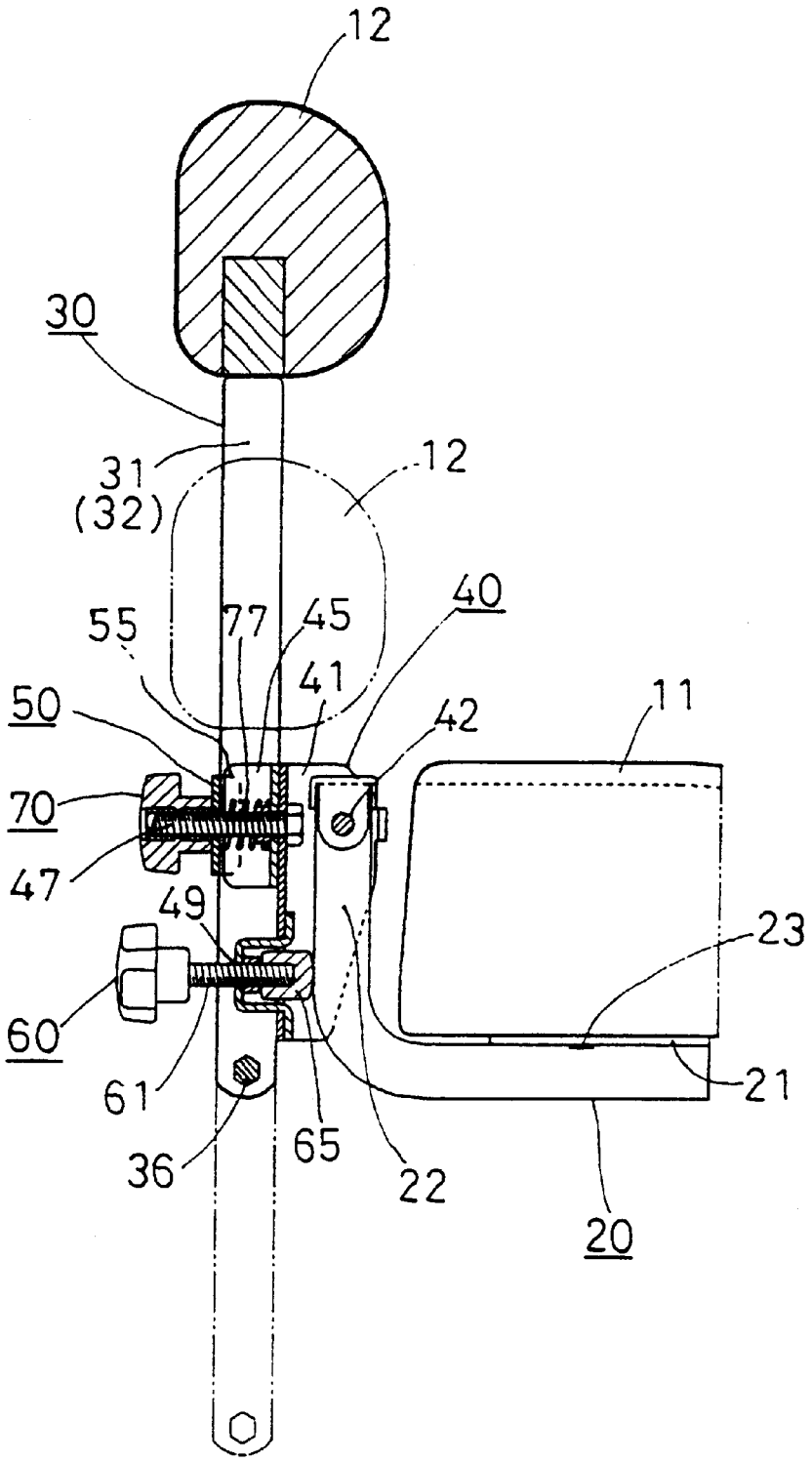
FIG. 4 is a longitudinal section showing the adjusted state of the height of the main backrest body.
Figure 7:
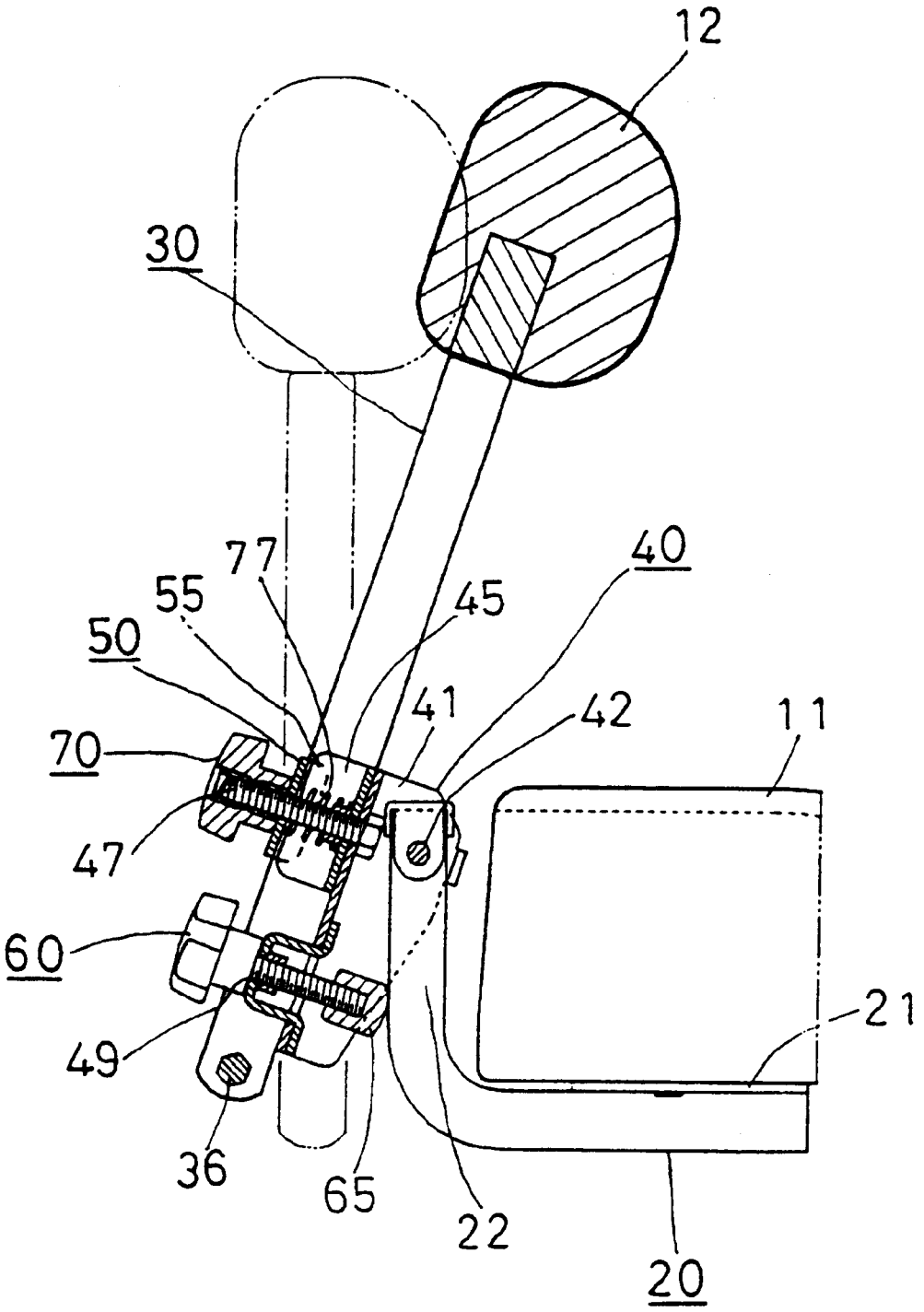
FIG. 7 is a cross section showing the angular adjustment of the main backrest body.

Comparing FIGS. 4 and 7, the contact distance, before engagement between part 22 of the body 20 and the contact part 65 at the tip of the screw 60, is changed by adjusting the back and forth adjusting screw member 60. This correspondingly rotates the arm holding member 40 around the axial support 41 for adjusting the angle of the main backrest body 30.

The arm fixing nut 70 fixes two arms 31 and 32 at the right and at the left at the arm holder 40 by the arm holding plate 50. The nut 70 is screwed from outside the arm holding plate 50 onto the arm fixing screw 47 of the arm holder 40. A spring 77 gives the arm holding plate 50 a continuous outward bias.

The height and angle adjustments of the backrest of the chair are explained with reference to FIGS. 4 through 8.

Adjustment of the height of the backrest 12 is performed by sliding the arms 31 and 32 of the main backrest body 30 in the vertical direction along the arm sliding part 45 of the arm holder 40. Where the height of arms 31 and 32 is to be fixed, the arm fixing nut 70 is tightened, as shown in FIGS. 4 and 5. The insides of the arms 31 and 32 are in close contact with the arm sliding part 45 and, in addition, the outside of the arms 31 and 32 are in close contact with the flanges 55 and 56 of the arm holding plate 50.

Figure 6:
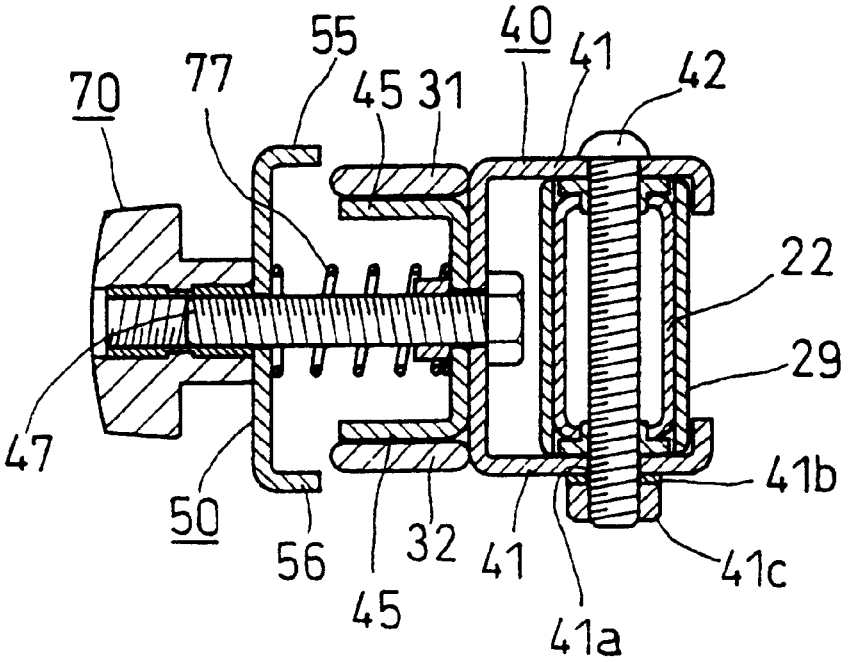
FIG. 6 is a similar cross section showing the state in which the arm holding plate has been separated from the arm holding member.

When the height of the backrest 12 is to be adjusted, the arm fixing nut 70 is loosened, as shown in FIG. 6, and the flanges 55 and 56 of the arm holding plate 50 are separated from the two arms 31 and 32, thereby releasing the fixed state of the arms 31 and 32. The right and left arms 31 and 32, which are spaced apart at a distance by the spacer 36, move along the outside of the arm sliding part 45 as they slide in the up and down directions.

After the backrest part 12 has been set at a suitable height, the arm fixing nut 70 is tightened and the flanges 55 and 56 of the arm holding plate 50 are arranged outside of the arm parts 31 and 32 for fixing.

Next, the angle of the backrest 12 can be adjusted by moving the contact part 65 on the screw part 61 of the back and forth adjustment screw 60 back and forth to rotate the arm holding member 40 around its axial support 41. During adjustment of the angle of the backrest part 12, if the back and forth adjustment screw 60 is moved toward the upstanding part 22, and as the part 22 is pressed, the arm holder 40 where the main backrest body 30 is held is rotated toward the seat 11 around the axle bolt 42, as shown in FIG. 7, which tilts the backrest 12 and the arms 31 and 32. On the other hand, if the back and forth adjusting screw 60 is returned, the backrest main body 30 is tilted backward.

The structure of the invention permits the backrest main body 30 with a backrest part 12 to be detached from the main base body 20. This leaves the seat 11 with the arm holder 40, the arm holding part 50, the back and forth adjustment screw 60 and the arm fixing nut 70 fixed at the upstanding part 22.

The main backrest body 30 can be removed by rotating the arm holding plate 50 over 90 degrees, with its insertion hole 52 as the rotation center, as is shown in FIG. 8. The arm holding plate 50 is of a size to be accommodated between the arms 31 and 32 of the backrest main body 30 after that rotation of 90 degrees with the insertion hole 52 as the center. The body 30 can be detached smoothly.

As has been explained above, the invention makes it possible to adjust the position of the chair backrest as the performer wishes as to the height and angular adjustment of the backrest with respect to the seat and the adjustment is easily performed by the back and forth adjusting screw and the arm fixing nut. Free adjustment of the position of the backrest enables a performer to play at a position he likes best and to avoid a problem of unintentional contact during the course of the performance.

As the backrest main body can be detached, it can be conveniently divided into the main backrest body and the rest of the seat, e.g. when it is to be transported or stored.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A backrest and a chair, wherein the chair comprises a seat, a support for the seat and the backrest above the seat, the seat having a rear side; the backrest is adjustable both as to its height and its angle of tilt with respect to the seat of the chair and is detachable from the seat, the backrest comprising:

a main base body including a seat part which is attachable to the seat of the chair and an upstanding part at the rear side of the seat;

a main backrest including upstanding arms spaced a distance apart, and a backrest part supported on the arms;

an arm holder comprised of a support which is held at the upstanding part of the main base body of the backrest and is comprised of an axis extending horizontally and oriented for enabling the backrest to pivot toward and away from the seat around the axis; the arm holder including an arm sliding part which slidably engages the arms of the backrest;

an arm holding plate positionable at the side of the arms away from the arm holding member and including side flanges slidingly contacting the arms of the backrest; an opening through the arm holding plate;

an arm fixing screw which extends through the arm holder and through the opening in the arm holding plate, an arm fixing nut screwed on to the arm fixing screw from the outside the arm holding plate for securing the arm holding plate against the arms of the backrest, whereby when the arm fixing nut is loosened, the arm of the backrest may be moved to raise and lower the backrest, and when the arm fixing nut is tightened on the arm fixing screw, the backrest is set in height;

a front and back motion adjusting screw, the arm holder having a threaded opening therein for receiving the front and back motion adjusting screw so that the extent to which the adjusting screw may project from the arm holder toward the seat is adjustable;

a contact part on the adjusting screw and the adjusting screw and its contact part being positioned for engaging the upstanding part of the main base body at the contact part, such that the rotation of the adjusting screw with respect to the arm holder adjusts the tilting of the arm holder with respect to the seat and thereby adjusts the tilt of the backrest with respect to the seat by pivoting the arm holder and the backrest around the axis of the arm holder.

2. The backrest and chair of claim 1, wherein the arms are parallel to each other, and the arms have inner sides facing each other and having opposite outsides; the arm sliding part of the arm holder comprising left and right arms sliding parts which respectively engage the inner sides of the arms; and the arm holding plate having left and right flanges which slidingly contact the outsides of the arms.

3. The backrest and chair of claim 2, wherein the arm holding plate is of such height that the arm holding plate may be rotated with respect to the backrest such that the arm holding plate fits entirely between the arms with the flanges in the space between the arms, and the arm fixing screw supports the arm holding plate and serves as a rotation axis for the holding plate to be rotated from between the arms to a position where the flanges slidingly contact the outsides of the arms.

* * * * *